United States Patent [19]

Rueda Segura

[11] 4,031,353

[45] June 21, 1977

[54] ELECTRIC RADIANT HEATER

[75] Inventor: Eduardo Rueda Segura, Madrid, Spain

[73] Assignee: Empresa De Representaciones Unidas, S.A. (Erusa), Madrid, Spain

[22] Filed: Apr. 9, 1975

[21] Appl. No.: 566,326

[30] Foreign Application Priority Data

| | | |
|---|---|---|
| Apr. 11, 1974 | Germany | 2417960 |
| Apr. 11, 1974 | Germany | 2417961 |
| Apr. 11, 1974 | Germany | 7412971[U] |
| Apr. 11, 1974 | Germany | 7412972[U] |

[52] U.S. Cl. ..... 219/345; 219/352; 219/355; 219/377; 219/543; 338/308

[51] Int. Cl.[2] ..... H05B 3/22; F24D 13/02; F24H 9/04; H01C 1/012

[58] Field of Search ... 219/345, 342, 353, 354–357, 219/339, 343, 543, 462, 464, 460, 461, 377; 338/292, 306– 309

[56] References Cited

UNITED STATES PATENTS

| | | | |
|---|---|---|---|
| 1,257,106 | 2/1918 | Parkhurst | 219/457 |
| 2,525,850 | 10/1950 | Andersen | 219/343 |
| 2,742,556 | 4/1956 | Bovenkerk | 219/353 X |
| 3,539,770 | 11/1970 | Wallace | 219/342 |
| 3,767,895 | 10/1973 | Needham | 219/543 X |
| 3,895,216 | 7/1975 | Hurko | 219/543 X |

FOREIGN PATENTS OR APPLICATIONS

| | | | |
|---|---|---|---|
| 359,221 | 12/1962 | Switzerland | 219/345 |
| 864,560 | 4/1961 | United Kingdom | 219/345 |

*Primary Examiner*—A. Bartis
*Attorney, Agent, or Firm*—Wenderoth, Lind & Ponack

[57] ABSTRACT

An improved radiant heater has a metal heating plate formed with at least one bulged portion surrounded by a flat transversely extending peripheral flange. Each of the bulged portions has a concave curved inner surface and a convex curved outer heat radiating surface. At least the entire concave surface of each bulged portion is covered with a coating of vitrified enamel and a printed circuit electric heating element is deposited on the enamel coating. A peripheral transition area is provided adjacent the intersection of each of the bulged portions and its surrounding flange. The transition areas are so shaped as to impart stress upon thermal deformation of the heating plate such that the enamel coating is compressed thereby increasing the dielectric resistance of the coating.

7 Claims, 12 Drawing Figures

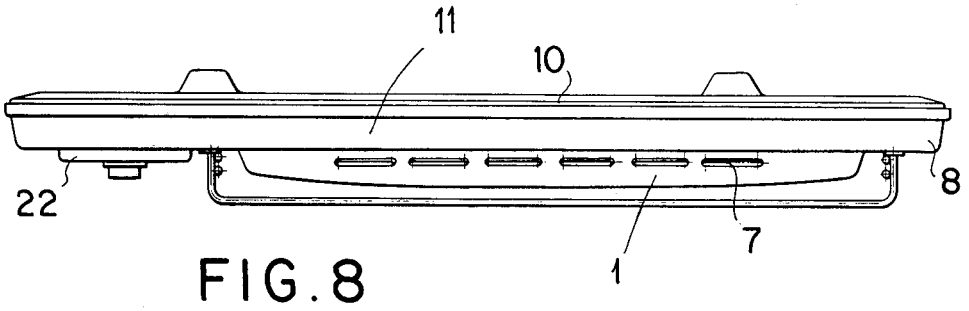
FIG. 8
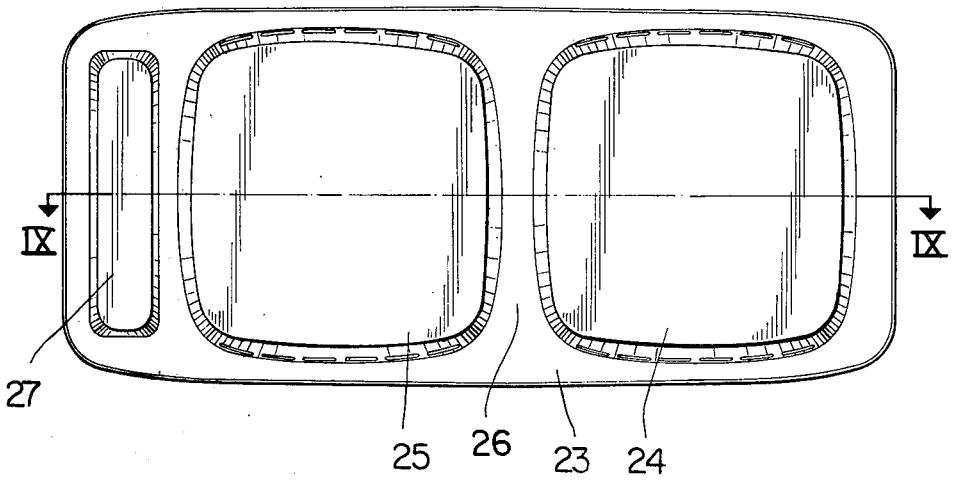
FIG. 10
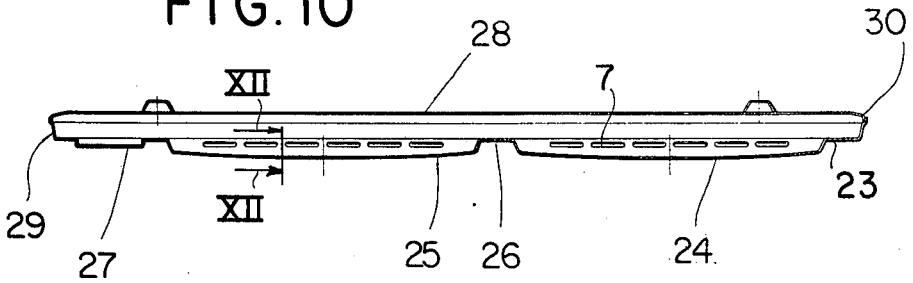
FIG. 11
FIG. 12
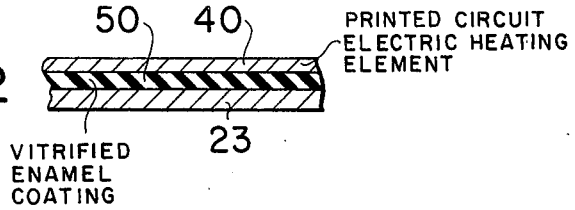

ELECTRIC RADIANT HEATER

BACKGROUND OF THE INVENTION

This invention relates to improvements in the construction of electric heaters of the type including a heating plate formed by a steel plate coated with a dielectric insulator, preferably vitrified enamel, such plate having on one of the faces thereof a printed circuit, thus forming an electrical resistance which, when connected to a feed network, emits a focused heat.

Heating plates of this type which presently exist in the market consist of a mere flat plate, generally rectangular in shape, the heating of which, when in operation, gives rise to certain disadvantages, the most serious being uncontrolled deformation of the plate due to expansion and contraction thereof produced when the plate is successively heated and cooled.

The deformation of the plate itself produces a series of disturbing noises which are objectionable.

In order to avoid both the uncontrolled deformation of the plate and the emission of noises during operation of the heater, the radiant plates are firmly fixed to a frame which conforms in shape to the radiant plates, but which, nevertheless, does not prevent the appearance of such harmful and annoying phenomena.

The uncontrolled deformation of the plate subjects the porcelain-like dielectric coating to bending stresses, produced by the twisting of the plate, which are not withstood by such coating. Thus, crevices or cracks, commonly known as "hair lines," are produced. Under such circumstances the printed circuit becomes connected to the frame and the heating plate then becomes useless.

Logically, the twisting or uncontrolled deformation of the plate is a direct function of the temperatures produced by the printed circuit when heated. Therefore, it can be affirmed that the admissible power limit for a flat plate has a value of approximately 0.4 watts/cm$^2$, which provides an average surface temperature in the range of about 170° C.

SUMMARY OF THE INVENTION

The object of the present invention is to provide an electric heating plate capable of overcoming the above disadvantages of prior art plates, while at the same time increasing the wattage per unit of the surface of the plate up to a value of approximately 0.7 watts/cm$^2$, which would provide an average surface temperature of approximately 230° C. on the outer face of the plate.

This object is achieved in accordance with the present invention in that the heating plate is concave and is obtained from a flat steel plate which is deformed by any means, such as folding, drawing, etc., thereby imparting thereto a concave curvature which has a perimeter intersecting a transversely extending flange in the original plane and at such intersection a bead which stiffens the plate and permits the direction and magnitude of the concavity to be controlled when the plate is heated.

That is, in accordance with the present invention, there is manufactured a rigid concave plate having at the perimeter thereof a bead, whereby upon heating the plate there is created a stress on the concave surface tending to increase the concavity. Therefore, upon heating the plate the vitrified enamel coating positioned on the concave surface, which receives the printed circuit, is compressed, thereby increasing the dielectric resistance of the vitreoporcelain-like film.

Such a concave heating plate having a flat transversely extending perimetric flange is more advantageous than the conventional flat plates, since deformation of thermal origin will be produced in the same direction in which the curvature was formed.

The average maximum temperature to which the curved surface of the plate can be subjected permits a greater heat radiation, since it is a known fact that radiation energy is directly proportional to the fourth power of the average surface temperature.

It should be emphasized that the heat is distributed by the curved concave plate over a much larger space than by a flat plate, since each point on the plate surface radiates therefrom heat at a direction normal to the surface. Thus, diffusion of heat from a flat plate, considered for example to be vertically arranged on the wall of a room, is only within a horizontal band and not also upwardly, downwardly and towards both sides, as occurs with a plate according to the invention.

Another object of the present invention is to join the heating plate and a thermal reflector plate to form a heating assembly by screws or other means, such as a series of flexible, U-shaped clips. The length of the free legs of each such clip is preferably approximately equal to the width of the flange of the heating plate and of a flange of the reflector plate.

The joining clips are regularly spaced along the periphery of the heating assembly.

Another object of the present invention is to provide a frame which acts as a support for the heating assembly and which is similar in size thereto, although slightly longer. The ends of plates forming the frame are folded or bent at the peripheries thereof to form outwardly extending flanges dimensioned to overlap or nest. Thus, a type of box is formed between two plates which form the frame.

The plate which forms the front face of the frame has an opening through which the outwardly bulging or extending portion of the heating plate of the heating assembly extends.

The heating assembly is fixed, for example by means of screws, to the rear plate of the frame.

The two plates forming the frame are joined to each other by means such as, for example, bent and screwthreaded ends of a bar which forms a grill frame which covers the portion of the heating plate which projects through the opening in the front plate of the frame.

The necessary electric connection and any regulating mechanisms may be housed in an inner space of the frame which may be provided by a portion of the frame which exceeds the dimension of the heating assembly. Such mechanisms may be regulated by means of controls provided in a panel forming part of the front plate of the frame.

Another object of the present invention is to provide an electric heater wherein, as another embodiment of the invention, the heating plate having thereon a printed circuit is an integral part of the frame itself. In such an arrangement, the provision of screws, rivets, or similar elements is not necessary to fix a separate heating plate to a support frame.

The curved concave heating plate itself will form the front portion of the heating element and will include, besides the heat emitting zone or zones, a marginal portion acting as a support for devices which control the heater regulating mechanisms, such as a switch and a thermostat.

These mechanisms will preferably be fixed to the inner face of the rear plate.

BRIEF DESCRIPTION OF THE DRAWINGS

The electric heater or radiator according to the present invention will now be described in more detail with reference to the attached drawings, wherein:

FIG. 8 is an upper plan view of the heater of FIG. 7;

FIG. 10 is a front elevational view of an electric heater or radiator according to a second embodiment of the invention, wherein the heating plate forms an intergral part of the frame itself, and wherein the radiator can have more than one radiant heating plate;

FIG. 11 is a sectional view taken along line XI—XI of FIG. 10; and

FIG. 12 is an enlarged section taken along line XII—XII of FIG. 11.

DETAILED DESCRIPTION OF THE INVENTION

Figures 1, 2:
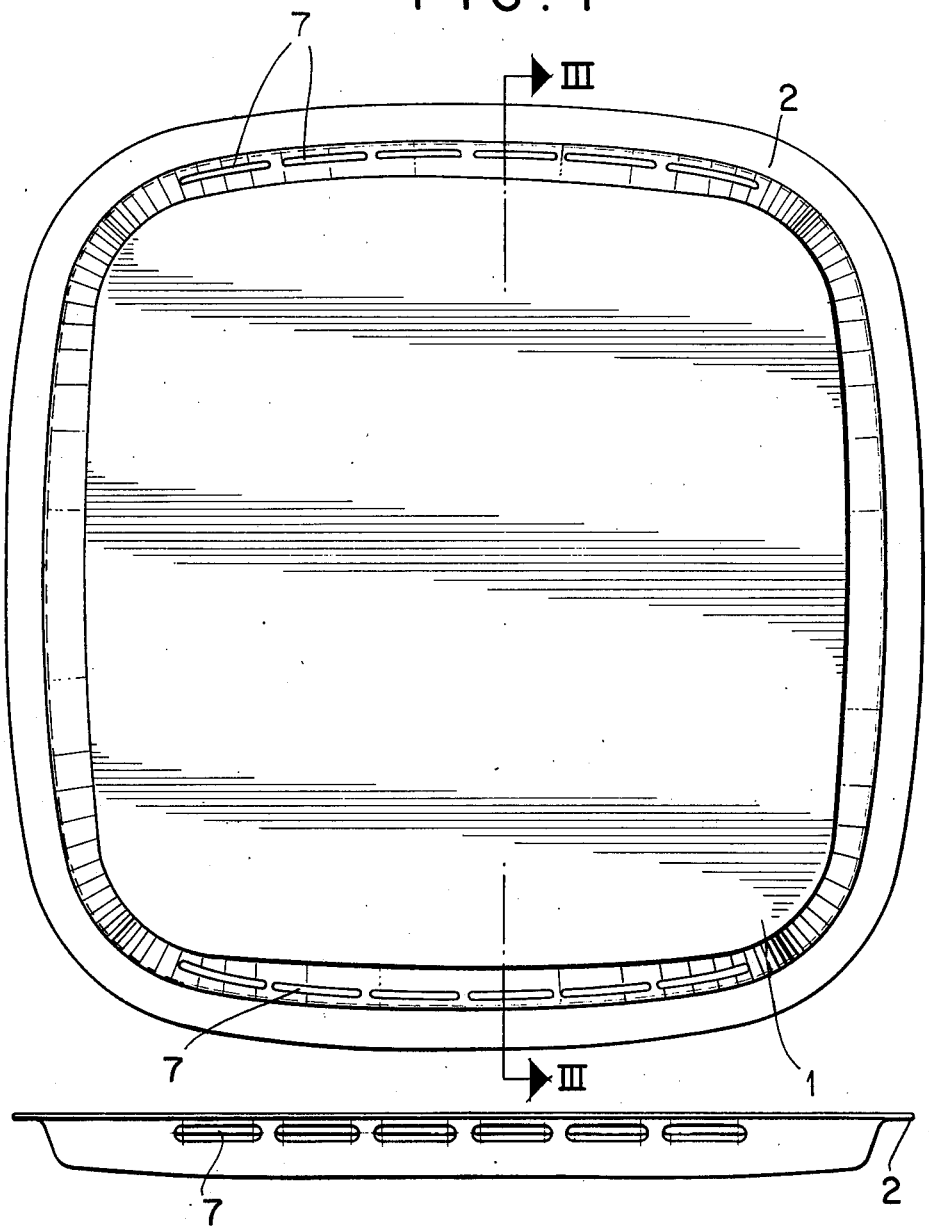
FIG. 1 is a front elevational view of a heating plate according to the invention.
FIG. 2 is an upper plan view of the plate of FIG. 1.
Figure 5:
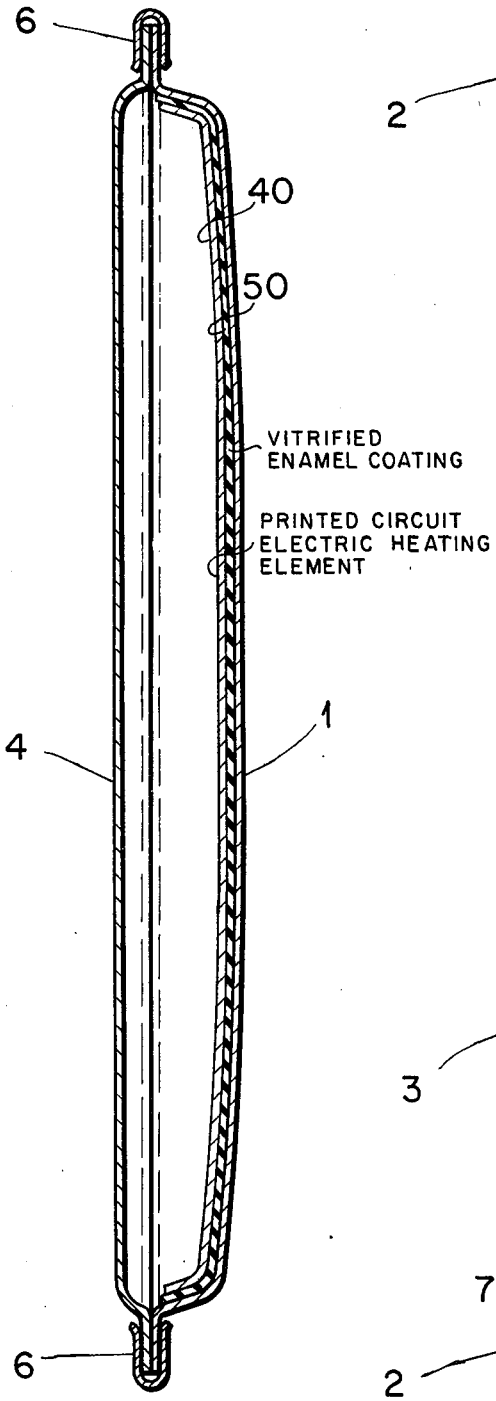
FIG. 5 is a sectional view of the heating assembly formed by the heating plate and the thermal reflector plate.
Figure 3:
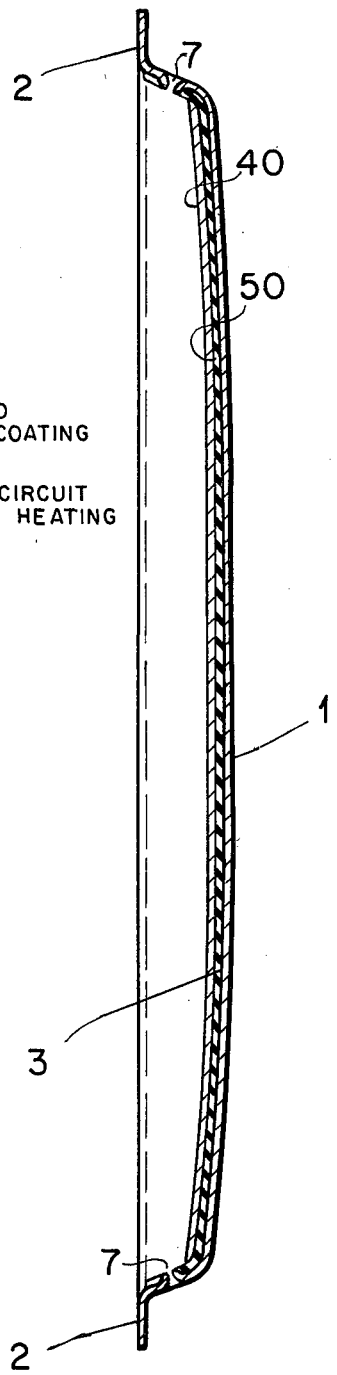
FIG. 3 is a sectional view taken along line III—III of FIG. 1.

In the drawings, a heating plate is formed as a concavely curved member by any mechanical process, such as drawing, folding, casting, injection, pressing, etc., from a flat steel plate from whose original plane an integral transversely extending perimetric flange 2 is maintained.

The curved portion of the heating plate will have a concave face 3 and a convex face 1. The concave face 3 of the plate has a layer of vitrified enamel 50 thereon, and a printed circuit of conventional design and shown at 40 is provided on the enamel coated concave face 3. The dimensions of layer 50 and circuit 40 are enlarged in the drawings for ease of illustration.

The peripheral line forming the juncture between the flat flange 2 and the curved portion of the heating plate forms a stiffening bead for the heating plate.

Upon heating the plate there is created a stress on the concave surface 3 tending to increase the concavity. Therefore, upon heating the plate the vitrified enamel coating 50 positioned on the concave surface, which receives the printed circuit 40, is compressed, thereby increasing the dielectric resistance of the vitreoporcelain-like film.

Such a concave heating plate having a flat transversely extending perimetric flange is more advantageous than the conventional flat plates, since deformation of thermal origin will be produced in the same direction in which the curvature was formed.

The printed circuit 40 will be deposited, for example by means of screen processing or any other known method, on the concave face 3 of the curved portion.

When the plate is vertically aligned as shown in the drawings, in the upper and lower zones of the plate, where the curved portion extends toward the flat flange 2, openings 7 are provided to permit cooling of the heating plate due to convection currents which are formed and flow through openings 7.

Figure 4:
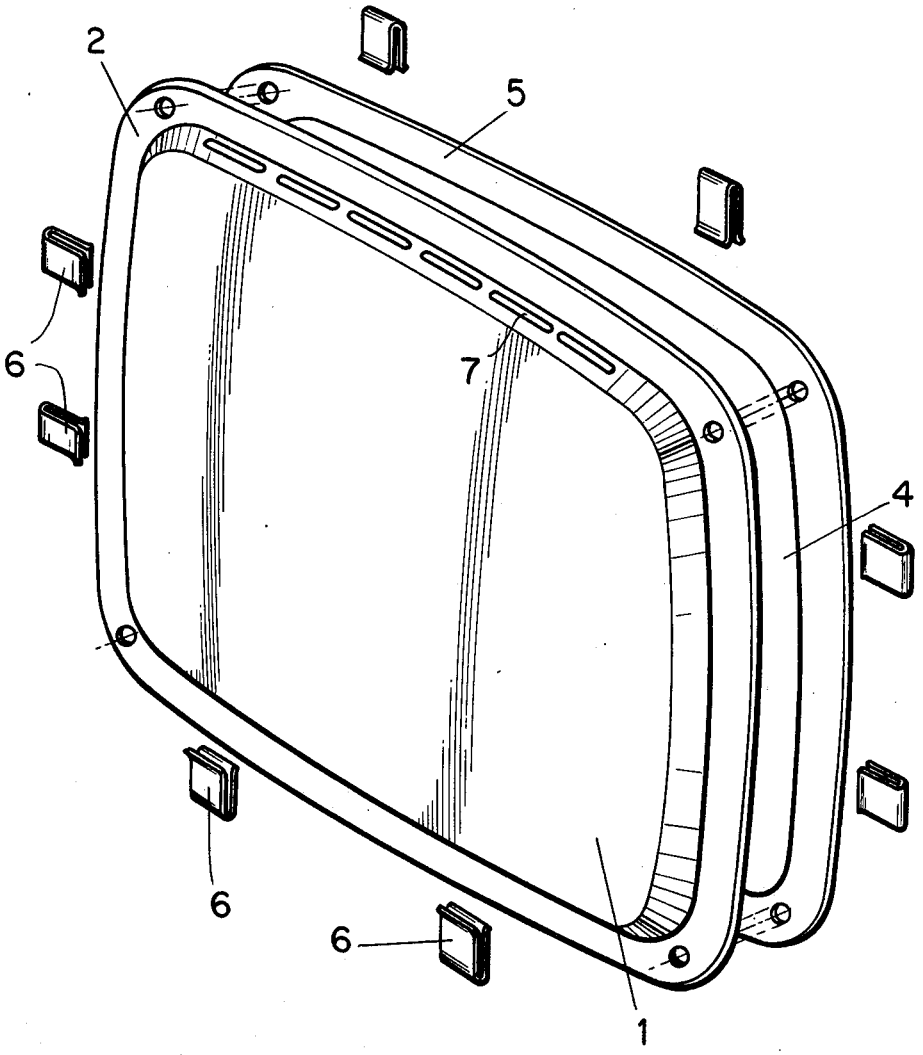
FIG. 4 is an exploded perspective view in a nearly assembled position of a heating assembly formed by the heating plate and by a thermal reflector plate.
Figure 6:
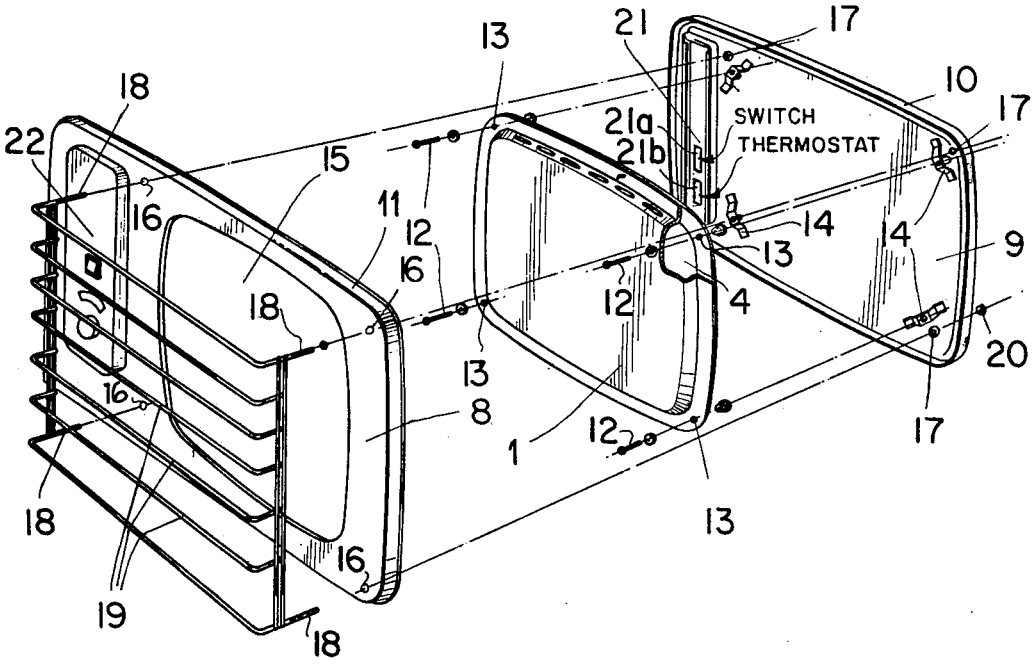
FIG. 6 is an exploded perspective view of the assembled heating assembly with respect to a support frame therefor.
Figure 7:
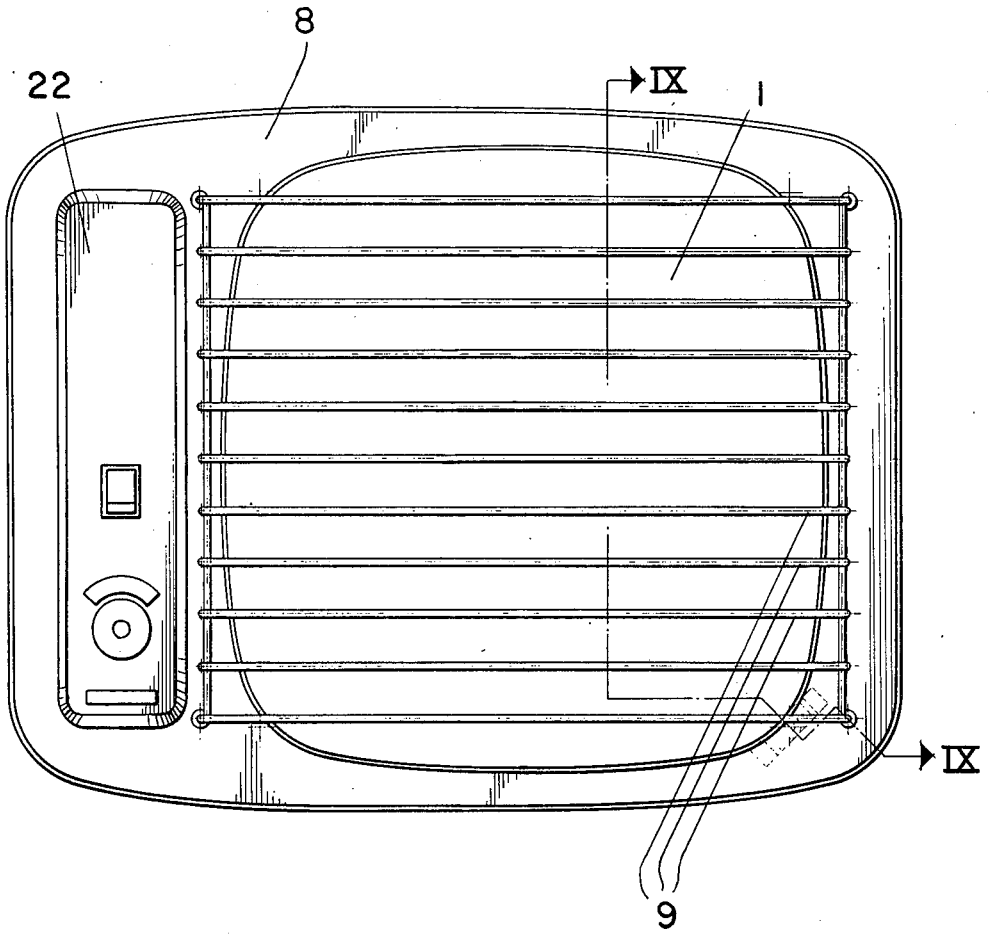
FIG. 7 is a front elevational view of the electric heater or radiator completely assembled in accordance with a first embodiment of the invention.

As shown in FIG. 4, the heating plate 1 is combined with another similarly shaped thermal reflector plate 4, in such a way that the concavities of the plates face each other, and such that the peripheral flange 2 of the heating plate and a similar flange 5 of the reflector plate are in back-to-back contact. Tightening of the two plates may be achieved by conventional means such as screws, or by other means such as a series of flexible U-shaped steel clips 6 which have sufficient flexibility so that they can clamp flanges 2 and 5 between their legs. Thus, the dismountable joining of the heating and reflector plates is achieved.

The respective ends of the legs of each clip 6 are slightly turned or bent outwardly, thus facilitating their assembly to the peripheral flanges 2 and 5.

This type of assembly of the heating plate and the thermal reflector plate provides a suitable means for absorbing expansion and contraction produced during operation of the heater.

From experiments, it has been demonstrated that a heating plate of the type described above, provided with a thermal reflector plate according to the invention, increases the yield of the heater by approximately 20 to 30%, since the heat emitted by the heating plate toward the rear of the heater is collected in the concavity of the reflector plate and is thereby reflected and directed forwardly.

Therefore, the heater according to the invention provides for greatly reduced thermal radiation losses at the rear portion of the heater. That is, due to the reflector plate, heat which would otherwise be absorbed by the rear wall of the apparatus is reflected forwardly, and therefore yield is greater at less wattage than with a plate not provided with a thermal reflector plate. Since substantially all the caloric energy is radiated towards the front of the heater, its use is less expensive inasmuch as the electric consumption is smaller at a given previously established temperature.

FIGS. 6 to 9 illustrate how the heating assembly or block formed by the heating plate and the thermal reflector plate 4 may be mounted between a pair of plates 8 and 9 which respectively form the front and rear parts of a support frame.

Figure 9:
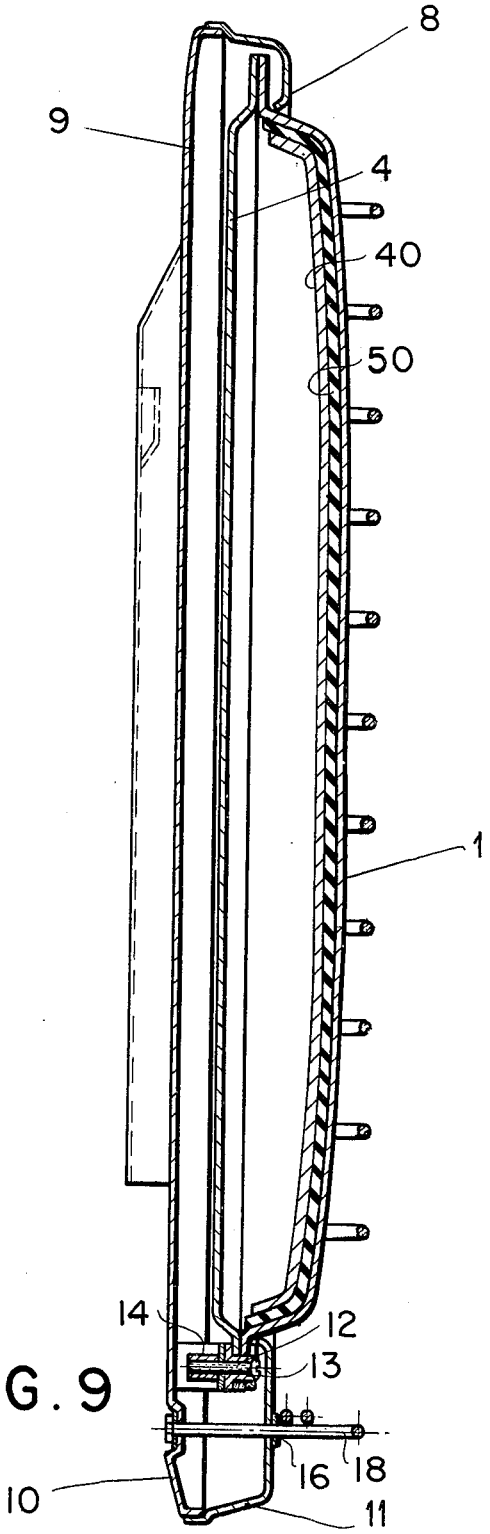
FIG. 9 is a sectional view taken along line IX—IX of FIG. 7.

The plates 8 and 9 have peripheral flanges 11 and 10, respectively, which extend outwardly and which are formed so that when plates 8 and 9 face each other flanges 11 and 10 overlap, as can be seen in the sectional view illustrated in FIG. 9.

The heating assembly is fixed to the inner face of rear frame plate 9 by means of screws 12 which pass through holes 13 formed in the rounded vertices of flanges 2 and 5 of the assembly. Screws 12 are threaded into holes provided in bridges 14 which are fixed, for example by means of welding, to points along the inner face of the rear plate 9 of the frame, the position of such bridges 14 coinciding with the holes 13 of the heating assembly.

The heater unit itself is thus mounted on the rear plate of the frame.

The front plate 8 has an opening 15 therein which conforms to the shape of the curved or bulge-like surface of the heating plate. The curved surface or portion of the heating plate extends through opening 15 and, at least partially, beyond the plane of plate 8.

Around the opening 15, at the vertices of an imaginary rectangle, the plate 8 has therethrough four holes 16 which coincide with other holes 17 at the rounded vertices of the rear plate 9.

Extending through holes 16 of the plate 8, as well as holes 17 of the plate 9, are bent ends 18 of bars which form part of a type of grill 19, which protects the curved part of the heating plate which projects through the opening 15 of the front plate 8 of the frame.

Nuts 20 are screwthreaded to the threaded ends 18, thus pressing together the two plates 9 and 8 which form the frame and the flanges 10 and 11 of which are overlapped or nested.

Plates 8 and 9 are laterally elongated at one side of the frame to provide a space at one side of the heating assembly. Within this space is coupled, for example by welding, a small box 21 to plate 9. Box 21 will have fixed therein mechanisms, such as a switch 21*a* and a thermostat 21*b*, which can be regulated by means of controls positioned on a panel 22 which can be attached to plate 8.

As shown in FIGS. 10 and 11, illustrating a second embodiment of the invention wherein the heating plate forms an integral part of the frame, the radiator can include two heating plates or curved surfaces, and the number of such plates or curved surfaces may be even greater.

In FIGS. 10 and 11, reference numeral 23 generically indicates the plate which is subjected to a metallic transformation process, giving rise to the formation of a pair of curved or bulged surfaces 24 and 25, which are separated by a zone 26 occupying a plane which is set back or recessed with respect to curved surfaces 24 and 25. Such surfaces 24 and 25 have characteristics similar to the heating plate described with reference to the first embodiment of the invention.

It is to be noted that although FIGS. 10 and 11 illustrate two bulge-like surfaces, the number thereof can vary.

In any case, the bulge-like surface or surfaces will extend outwardly of the plane of the surrounding zone.

At one side of the front plate 23 which includes the bulged portions 24 and 25, the concave surfaces of which have thereon vitrified enamel layers 50 and printed circuits 40, there is provided another deformation or bulge 27 forming a space wherein the controls to regulate the electric control devices are housed. Plate 23 is fixed to another plate 28, which will constitute the rear part of the heating element or electric heater. Plates 23 and 28 are coupled to each other by means of overlapping peripheral flanges 29 and 30.

The front plate 23 is formed of metal and coated with porcelain and has the advantages that, since it simultaneously constitutes a heat emitting element and the main part of the frame, a larger radiant surface as well as an increase in the stiffness of the assembly, with respect to other similar heaters, are obtained.

I claim:

1. An electric heater comprising:

metal heating plate having at least one curved bulged portion, each of said curved bulged portions being surrounded by a flat transversely extending peripheral flange, each of said curved bulged portions having a completely concave curved inner surface and a completely convex curved outer heat radiating surface, at least said concave curved inner surface having thereon a coating of dielectric vitrified enamel covering the whole of said concave curved inner surface and a printed circuit electrical resistance heating element deposited on said enamel coating;

a thermal reflector plate having a bulged portion surrounded by a transversely extending flange;

said heating plate and said thermal reflector plate being joined with the concavities of said heating plate and said thermal reflector plate facing each other, the thus joined heating plate and thermal reflector plate forming a heating assembly;

means for energizing said heating element for heating said heating plate to radiate heat from said convex outer surface;

means for supporting said heating assembly with said convex outer surface being exposed to a zone to be heated;

said heating plate undergoing deformation of a thermal origin upon operation of said resistance heating element; and a peripheral transition area, adjacent the intersection of each of said bulged portions and its surrounding flange of said heating plate, said transition area being so shaped as to comprise means for imparting a stress, upon deformation of said heating plate, always compressing said enamel coating covering said concave inner surface.

2. An electric heater as claimed in claim 1, further comprising a plurality of clips joining said flanges of said heating plate and said thermal reflector plate, each of said clips having a U-shaped configuration with bent outer ends.

3. An electric heater as claimed in claim 1, wherein said means for supporting said heating assembly comprises a frame, said frame comprises a front plate and a rear plate, said front plate having a rearwardly extending peripheral flange, said rear plate having a forwardly extending peripheral flange, said front and rear plates being joined with said respective flanges thereof overlapping to form a casing enclosing said heating assembly; screws extending through holes in said flanges of said heating plate and said thermal reflector and threading into connector elements fixed to said rear plate, said heating assembly thus being joined to said rear plate; said front plate having an opening therein through which extends said bulged portion of said heating plate; and a grate positioned over said bulged portion of said heating plate, said grate having bent threaded ends extending through holes in said front and rear plates and nuts threaded to said threaded ends, said front and rear plates thereby being joined to form said frame.

4. An electric heater as claimed in claim 3, wherein said front and rear plates are elongated on one side thereof to form a space laterally of said heating assembly; and further comprising a switch and thermostat mounted on said rear plate within said space, and controls arranged on said front plate and operatively connected to said switch and thermostat.

5. An electric heater as claimed in claim 1, wherein said heating plate has, around the periphery of said transversely extending flange thereof a rearwardly extending flange; said thermal reflector plate has, around the periphery of said transversely extending flange thereof, a forwardly extending flange; said heating plate and said thermal reflector plate being joined with said rearwardly and forwardly flanges thereof overlapping.

6. An electric heater as claimed in claim 5, wherein said heating plate has therein plural such curved bulged portions.

7. An electric heater as claimed in claim 1, wherein said heating assembly is supported with said flange of said heating plate aligned substantially vertically; and further comprising openings formed in upper and lower areas of said bulged portion of said heating plate, at positions therein adjacent said peripheral transition area, said openings permitting air to flow by convection through the heating assembly.

* * * * *